US005335376A

United States Patent [19]

Kaldewei

[11] Patent Number: 5,335,376

[45] Date of Patent: Aug. 9, 1994

[54] WHIRLPOOL BATHTUB

[76] Inventor: Franz-Dieter Kaldewei, Beckumer Strasse 33, D-4730 Ahlen, Fed. Rep. of Germany

[21] Appl. No.: 613,867

[22] PCT Filed: Mar. 2, 1990

[86] PCT No.: PCT/DE90/00149

§ 371 Date: Nov. 9, 1990

§ 102(e) Date: Nov. 9, 1990

[87] PCT Pub. No.: WO90/10428

PCT Pub. Date: Sep. 20, 1990

[30] Foreign Application Priority Data

Mar. 9, 1989 [DE] Fed. Rep. of Germany ..... 3912810

[51] Int. Cl.[5] ..... A61H 33/02

[52] U.S. Cl. ..... 4/541.6; 4/541.1; 239/428.5

[58] Field of Search ..... 4/492, 541, 542, 544; 239/428.5; 128/66

[56] References Cited

U.S. PATENT DOCUMENTS

| | | | |
|---|---|---|---|
| 4,520,514 | 6/1985 | Johnson | 4/492 |
| 4,853,987 | 8/1989 | Jaworski | 4/542 |
| 5,031,255 | 7/1991 | Hilger et al. | 4/542 |

FOREIGN PATENT DOCUMENTS

| | | | |
|---|---|---|---|
| 2319902 | 11/1974 | Fed. Rep. of Germany . | |
| 2408270 | 8/1975 | Fed. Rep. of Germany | 4/541 |
| 8804977 | 7/1988 | Fed. Rep. of Germany . | |
| 3716683 | 12/1988 | Fed. Rep. of Germany . | |
| 3800400 | 2/1989 | Fed. Rep. of Germany . | |
| 1134038 | 4/1957 | France | 4/541 |
| 8902263 | 3/1989 | World Int. Prop. O. | 4/542 |

*Primary Examiner*—Henry J. Recla
*Assistant Examiner*—Robert M. Fetsuga
*Attorney, Agent, or Firm*—Speckman & Pauley

[57] ABSTRACT

A whirlpool bathtub has a plurality of devices positioned in the tub wall and/or tub floor for generating water or water and air jets. Each device has a pump wheel positioned behind an impeller both facing the tub interior and fixed on a drive shaft of an electric motor capable of reversing motor rotation. When the electric motor rotates in one direction, the impeller aspirates water from the tub interior and returns the water through a central outlet as a water jet. When the electric motor is rotated in the opposite direction, both the impeller and pump wheel rotate where the pump wheel also aspirate water which is used to aspirate ambient air and then injected into the tub, thereby generating an air bubble massage. In other embodiments, the impeller free-wheels when the motor rotates in the opposite direction, and the impeller can aspirate air when the motor rotates in the one direction.

24 Claims, 2 Drawing Sheets

WHIRLPOOL BATHTUB

BACKGROUND OF THE INVENTION

1. Field of the Invention

The invention relates to a whirlpool bathtub having devices for generating water or air jets which are supplied to the tub interior from a plurality of positions on the tub wall and/or the tub floor an individual, drivable device for generating the water and/or air jet is assigned to each one of these positions, which are positioned on the tub wall or the tub floor or are built into the tub wall or the tub floor and which can be charged with drive energy from the outside of the tub. Each position has a nozzle housing with a pump wheel chamber and pump wheel which, in one direction of rotation, aspirates water from the tub interior through aspirating openings in a cover which closes off the nozzle housing towards the tub interior and supplies it from the pump wheel chamber to at least one conduit in the cover which terminates in at least one discharge opening directed into the tub interior.

2. Description of Prior Art

A whirlpool bathtub of this type is known from German Patent DE-PS 38 00 400. Water is delivered to the device in the form of a pump, which is used to aspirate air and in this way results in a water bubble massage.

A whirlpool bathtub is known from DE-OS 37 16 683 where the device provided at each position aspirates water and returns it to the tub interior as a water jet. This whirlpool bathtub is used for water jet massage. The known whirlpool bathtubs with devices provided for each position function in different modes of operation.

SUMMARY OF THE INVENTION

It is the object of the invention to provide a whirlpool bathtub of the previously mentioned type which, supplied with uniform devices, can be used optionally for water jet massage or air bubble massage.

This object is attained in accordance with this invention by a device which can be driven in both directions of rotation. The nozzle housing has an impeller chamber with an impeller facing the tub interior. The impeller aspirates water from the tub interior through the aspirating openings in the opposite direction of rotation from the pump wheel and supplies it to the tub interior through a central outlet opening in the cover in the form of a water jet.

Because of the use of both directions of rotation of the device, it is possible optionally to realize two modes of operation with the whirlpool bathtub. In one mode of operation the impeller wheel is rotated and generates a water jet for the water jet massage, while in the other mode of operation the pump wheel delivers water which is used to aspirate air and in this way results in an air bubble massage. The choice is made solely by the selection of the appropriate direction of rotation of the device.

In a preferred embodiment of this invention the device is driven by an electric motor, the direction of rotation of which can be reversed. The choice of mode is particularly simple and can be made by means of electrical switching commands.

In accordance with one embodiment of this invention the structural design of the device is such that the pump wheel and the impeller are disposed, fixed against relative rotation, one immediately behind the other on a drive shaft of the electric motor. In this arrangement the impeller, rotatable in the same direction as the pump wheel, assists the function of the pump wheel.

Improved water jet massage by the water jet in accordance with one embodiment of this invention is attained with aspirating openings distributed in a circle over the circumference of the impeller chamber. The aspirating openings are cut into the cover in the form of radially oriented slits and the outlet openings are formed by a retaining ring which is disposed in a centered opening of the cover having a sleeve-shaped jet guidance leading to the impeller chamber. Then the water jet issues from the impeller chamber in a directed manner.

The air bubble massage with the jet composed of water and air is achieved by an air conduit which terminates in the area of the outlet opening. The air conduit is connected to ambient air through air conduits outside of the tub interior through which air is aspirated in accordance with the Venturi principle and is supplied to the tub interior by the aspirated water. In this case the water is only used as a carrier for the small air bubbles.

Admixture of air to the water jet delivered by the impeller is possible in accordance with one embodiment of this invention. Air, which can be aspirated from the ambient air through air conduits in accordance with the Venturi principle, is admixed to the water jet aspirated by the impeller and delivered to the tub interior through outlet openings in the impeller chamber, the air conduits terminating in the area of the outlet opening of the impeller chamber.

So that the impeller or the pump wheel will not suck up any hair or the like, the centered outlet opening of the cover is covered with a protective grille which is connected with the jet guidance by means of the retaining ring.

Sealed installation of the device in an opening of the bathtub in spite of the rotating seating of the drive shaft of the electric motor is achieved where the pump wheel chamber is closed off towards the electric motor by a motor shield in which the drive shaft is seated in a rotatable, but sealed manner by a rotating mechanical seal. The rotating mechanical seal is supported on a bore of the motor shield and a sleeve of the pump wheel pushed onto and fixed on the drive shaft.

In accordance with yet a further embodiment, the pump wheel has a centered inlet opening oriented toward the impeller as well as a plurality of radial pump channels which end in the area of the circumferential wall of the pump wheel chamber and the outlet opening of the same.

Optimal bubble effect is achieved where the device is installed in the tub wall and the outlet opening of the pump wheel chamber is oriented in the direction towards the tub floor.

BRIEF DESCRIPTION OF THE DRAWINGS

The invention will be described in detail by means of an exemplary embodiment illustrated in the drawings.

DESCRIPTION OF PREFERRED EMBODIMENTS

Figure 1:
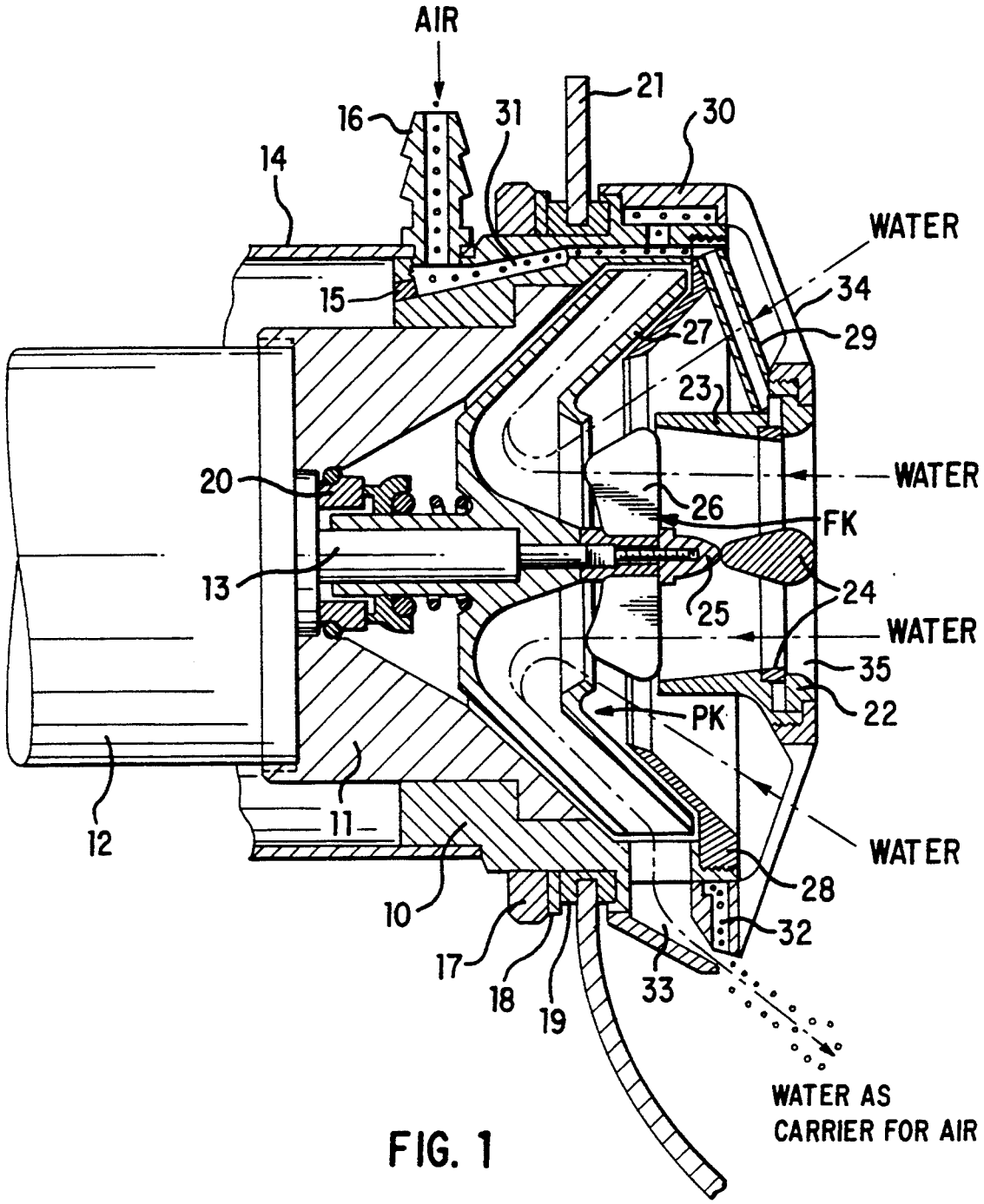
FIG. 1 shows a cross-section of the device, operating in the air bubble massage mode.

The exemplary embodiment shows a device which is suitable for installation in an opening of the tub wall 21 of a bathtub. The motor receiver 10, which has a support flange, is inserted into the opening. Together with the triple seal 19, the disk 18 and the threaded ring 17, which is screwed on an outer thread of the motor receiver 10, the motor receiver 10 is sealingly inserted into the opening of the tub wall 21. The electric motor 12 with the motor shield 11 is covered by the receiver cup 14, which is connected with the motor receiver 10. The drive shaft 13 of the electric motor 12 extends out from the motor shield 11 and supports, fixed against relative rotation, in succession the pump wheel 27 and the impeller 26. The cap nut 25 maintains the impeller 26 and the pump wheel 27 on the drive shaft 13. The impeller 26 faces the tub interior and is covered by means of the cover 30, which is screwed on at the flange of the cover 30 or connected in another way. The motor shield 11 and the intermediate ring 28 form the pump wheel chamber PK, while the impeller chamber FK is formed between the intermediate ring 28 and the cover 30. The pump wheel 27 is disposed in the pump wheel chamber PK which, like the intermediate ring 28, has a centered opening facing the impeller 26, which ends in a plurality of radial pump channels. These pump channels terminate at the circumferential wall of the pump wheel chamber PK, which is formed by the motor receiver 10. Facing the tub floor, the outlet opening 33 which starts at the pump wheel chamber PK, is cut into the motor receiver 10.

The air conduit 32, which is also cut into the motor receiver 10, terminates directly at the outlet opening 33 and is connected with the air conduits 31 leading to the hose connector 16. The stopper 15 closes off the last air conduit 31. An air hose, the free end of which terminates in the ambient air above the highest water level of the tub interior, is connected outside of the tube interior to the hose connector 16.

In the direction of the motor receiver 10 the cover 30 forms an annular chamber into which the air conduits 31 and 32 lead.

In the direction of the tub interior the cover 30 is provided with a circle of aspirating openings 34 in the form of radial slits which terminate in the impeller chamber FK in the circumferential area of the impeller 26. The cover 30 has a centered opening in which the jet guidance 23 to the impeller 26 is fixed by means of the retaining ring 22. The retaining ring 22 simultaneously fixes the protective grille 24 which forms the outlet opening 35 from the impeller chamber FK. The centered guide body is connected with a circumferential bar of the protective grille 24 by means of radial bars. The slits remaining between the bars form the outlet opening 35.

FIG. 1 illustrates the air bubble massage mode, in which the electric motor 12 is operated in the direction of rotation in which the pump wheel 27 operates. Water is aspirated through the aspirating openings 34 of the cover 30 of the impeller chamber FK and reaches the pump wheel chamber PK through the intermediate ring 28 and is guided from there through the pump channels to the outlet opening 33. Based on the Venturi principle, the water flowing from the outlet opening 33 aspirates air from the ambient air through the air conduit 32, which is supplied to the tub interior in the form of air bubbles. In this case the water is only used as a carrier. Water is also aspirated through the outlet opening 35 of the impeller chamber FK, in which case the impeller 26 aids the aspiration of water in this direction of rotation, as shown by the dash-dotted lines drawn in FIG. 1. So that the impeller 26 acts in support, the vanes are set obliquely on the hub of the impeller 26 in such a way, that they also aspirate water through the outlet opening 35 of the impeller chamber FK. The circles suggest the aspirated air stream which is supplied to the tub interior in the form of air bubbles carried by the water.

Figure 2:
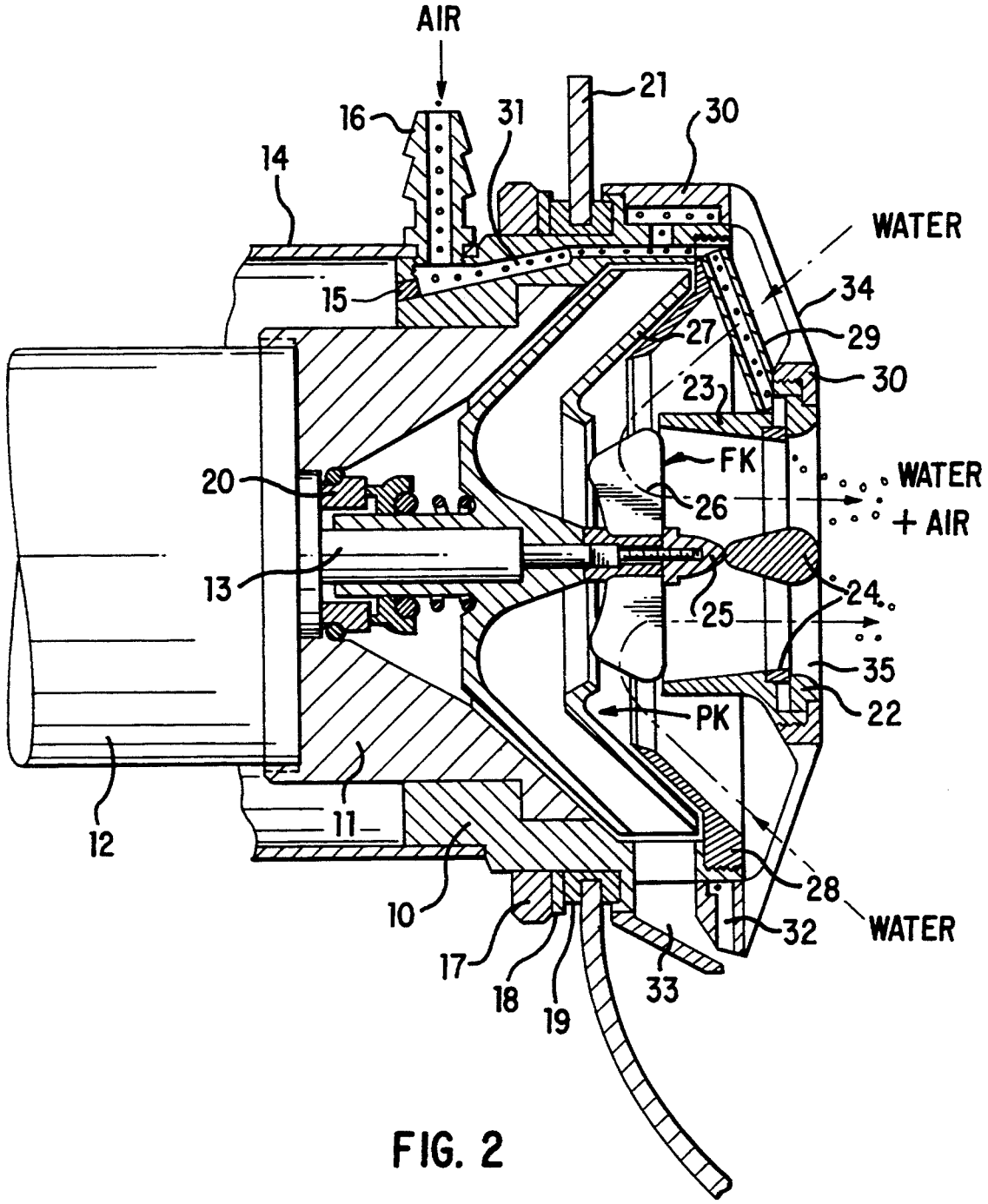
FIG. 2 shows a cross-section of the device, operating in the water jet massage mode.

As shown in FIG. 2, it is possible to select the operational mode of water jet massage by reversal of the direction of rotation of the electric motor 12. In this case the impeller 26 turns in such a way that water is aspirated through the aspirating openings 34 in the cover 30 and is discharged as a water jet through the centered outlet opening 35. In this direction of rotation the pump wheel 27 does not rotate. The amount of water aspirated by the impeller 26 can be very large. In the water jet massage mode it is also possible to increase the rpm simultaneously with the reversal of the direction of rotation.

It is possible to admix air to the water jet if the device has air conduits 29, which are in the form of connecting pipes. The air conduits 29 are connected with the ambient air through the air conduits 31 and terminate in the area of the outlet opening 35 of the impeller chamber FK, namely in the area of the jet guidance 23. In this case the protective grille 24 has openings at the ends of the air conduits 29, so that the exiting water jet can aspirate air bubbles from the air conduits 29 in accordance with the Venturi principle and can carry them along. The air conduits 29 may be connected with an annular conduit which is in connection with the hose connector 16 by means of the air conduit 31. A plurality of air conduits 29 are then disposed evenly angled over the circumference of the jet guide 23 and too the outlet opening 35 in the protective grille 24 in order to admix air to the water jet at several locations. The dash-dotted lines indicate the course of flow of the water and the circles indicate the air bubble flow.

So that the impeller 26 only operates in the direction of rotation for generating the water jet and does not interfere with the function of the pump wheel 27, it may be provided that the impeller 26 is connected with the motor shaft 13 fixed against relative motion only in the direction of rotation for generating the water jet, while it is free-wheeling on the motor shaft in the opposite direction.

I claim:

1. In a whirlpool bathtub having a plurality of devices for generating at least one of a plurality of water jets and a plurality of water and air jets to a tub interior, said devices being built into individual positions on at least one of said tub wall and said tub floor, said devices being provided with drive energy from an outside of said tub, each of said positions having a nozzle housing open towards said tub interior with a pump wheel chamber and a pump wheel, said pump wheel disposed on a drive shaft driven by said drive energy, said pump wheel being fixed against relative rotation in one direction of rotation thereby aspirating water from said tub interior and air from the ambient through aspirating openings in a cover, said cover closing off said nozzle housing towards said tub interior and supplying said water and air from said pump wheel chamber to at least one discharge opening directed into said tub interior, the improvement comprising:

each of said devices being driveable in both directions of rotation, said nozzle housing having an impeller (26) facing said tub interior, said impeller (26) being disposed on said drive shaft (13), and fixed against relative rotation in at least one direction of rotation, said impeller (26) aspirating said water from said tub interior through said aspirating openings (34) in an opposite direction of rotation from said pump wheel (27) and supplying said water to said tub interior through a central outlet opening (35) in said cover (30) as said water jet.

2. A whirlpool bathtub in accordance with claim 1, wherein each of said devices is driven by an electric motor (12) having reversible motor rotation.

3. A whirlpool bathtub in accordance with claim 2, wherein said impeller (26) and said pump wheel (27) are positioned, fixed against relative rotation, on said drive shaft (13) of said electric motor (12), said pump wheel (27) being behind said impeller (26).

4. A whirlpool bathtub in accordance with claim 3, wherein said aspirating openings (34) are distributed in a circle in said cover.

5. A whirlpool bathtub in accordance with claim 4, wherein said aspirating openings (34) comprise radially oriented slits in said cover (30), said cover (30) having a centered opening, and said central outlet opening (35) is formed by a retaining ring (22) disposed in said centered opening of said cover (30) by a sleeve-shaped jet guidance (23).

6. A whirlpool bathtub in accordance with claim 5, wherein a first air conduit (32) terminates in a first area of said pump wheel chamber proximate said discharge opening (33), said first air conduit (32) being in communication with ambient air through at least one primary air conduit (31) formed in said nozzle housing and said ambient air being aspirated in accordance with the Venturi principle and supplied to said tub interior by the aspirated water.

7. A whirlpool bathtub in accordance with claim 6, wherein said ambient air is aspirated through a second air conduit (29) in communication with said primary air conduit (31) and is admixed to said water jet aspirated by said impeller (26) and delivered to said tub interior through said central outlet opening (35), said second air conduit (29) terminating in a second area of said pump wheel chamber proximate said central outlet opening (35).

8. A whirlpool bathtub in accordance with claim 7, wherein said central outlet opening (35) is covered with a protective grille (24), which is connected to said jet guidance (23) by said retaining ring (22).

9. A whirlpool bathtub in accordance with claim 8, wherein said pump wheel chamber (PK) is sealed from said electric motor (12) by a motor shield (11) in which said drive shaft (13) is seated in a rotatable, but sealed manner by a rotating mechanical seal (20).

10. A whirlpool bathtub in accordance with claim 9, wherein said rotating mechanical seal (20) is supported on a bore of said motor shield (11) and a sleeve of said pump wheel (27) pushed onto and fixed on said drive shaft (13).

11. A whirlpool bathtub in accordance with claim 10, wherein said pump wheel (27) has a centered inlet opening oriented toward said impeller (26) as well as a plurality of radial pump channels which end in a wall area of a circumferential wall of said pump wheel chamber (PK) and said discharge opening (33).

12. A whirlpool bathtub in accordance with claim 11, wherein each of said devices is installed in said tub wall and said discharge opening (33) is oriented towards said tub floor.

13. A whirlpool bathtub in accordance with claim 12, wherein said impeller (26) is connected to said drive shaft (13) fixed against relative motion only in said opposite direction of rotation from said pump wheel (27) for generating said water jet, while it is free-wheeling on said drive shaft (13) in said one direction of rotation.

14. A whirlpool bathtub in accordance with claim 1, wherein said impeller (26) and said pump wheel (27) are positioned, fixed against relative rotation, on said drive shaft (13) of an electric motor (12), said pump wheel (27) being behind said impeller (26).

15. A whirlpool bathtub in accordance with claim 1, wherein said aspirating openings (34) are distributed in a circle in said cover.

16. A whirlpool bathtub in accordance with claim 15, wherein said aspirating openings (34) comprise radially oriented slits in said cover (30), said cover (30) having a centered opening, and said central outlet opening (35) is formed by a retaining ring (22) disposed in said centered opening of said cover (30) by a sleeve-shaped jet guidance (23).

17. A whirlpool bathtub in accordance with claim 16, wherein said central outlet opening (35) is covered with a protective grille (24), which is connected to said jet guidance (23) by said retaining ring (22).

18. A whirlpool bathtub in accordance with claim 1, wherein a first air conduit (32) terminates in a first area of said pump wheel chamber proximate said discharge opening (33), said first air conduit (32) being in communication with ambient air through at least one primary air conduit (31) formed in said nozzle housing and said ambient air being aspirated in accordance with the Venturi principle and supplied to said tub interior by the aspirated water.

19. A whirlpool bathtub in accordance with claim 1, wherein said ambient air is aspirated through a second air conduit (29) in communication with at least one primary air conduit (31) formed in said nozzle housing and is admixed to said water jet aspirated by said impeller (26) and delivered to said tub interior through said central outlet opening (35), said second air conduit (29) terminating in a second area of said pump wheel chamber proximate said central outlet opening (35).

20. A whirlpool bathtub in accordance with claim 1, wherein said pump wheel chamber (PK) is sealed from an electric motor (12) by a motor shield (11) in which said drive shaft (13 is seated in a rotatable, but sealed manner by a rotating mechanical seal (20).

21. A whirlpool bathtub in accordance with claim 20, wherein said rotating mechanical seal (20) is supported on a bore of said motor shield (11) and a sleeve of said pump wheel (27) pushed onto and fixed on said drive shaft (13).

22. A whirlpool bathtub in accordance with claim 21, wherein each of said devices is installed in said tub wall and said discharge opening (33) is oriented towards said tub floor.

23. A whirlpool bathtub in accordance with claim 1, wherein said pump wheel (27) has a centered inlet opening oriented toward said impeller (26) as well as a plurality of radial pump channels which end in a wall area of a circumferential wall of said pump wheel chamber (PK) and said discharge opening (33).

24. A whirlpool bathtub in accordance with claim 1, wherein said impeller (26) is connected to said drive shaft (13) fixed against relative motion only in said opposite direction of rotation from said pump wheel (27) for generating said water jet, while it is free-wheeling on said drive shaft (13) in said one direction of rotation.

* * * * *